United States Patent [19]

Foye

[11] 3,945,425

[45] Mar. 23, 1976

[54] MOLD ALIGNMENT DEVICE FOR HORIZONTAL CASTING

[75] Inventor: John J. Foye, Livermore, Calif.

[73] Assignee: Kaiser Aluminum & Chemical Corporation, Oakland, Calif.

[22] Filed: Mar. 28, 1975

[21] Appl. No.: 563,277

[52] U.S. Cl...... 164/137; 164/273 R; 164/281; 164/341

[51] Int. Cl.[2]..... B22D 11/14; B22D 33/04

[58] Field of Search..... 164/82, 137, 273 R, 281, 164/341

[56] References Cited

UNITED STATES PATENTS

| | | | |
|---|---|---|---|
| 3,344,845 | 10/1967 | Blessinger et al. | 164/274 |
| 3,550,672 | 12/1970 | Fastert et al. | 164/273 R |
| 3,757,405 | 9/1973 | Kurth et al. | 164/282 X |
| 3,777,436 | 12/1973 | Bode, Jr. | 164/273 R X |

*Primary Examiner*—R. Spencer Annear
*Attorney, Agent, or Firm*—Paul E. Calrow; Edward J. Lynch

[57] ABSTRACT

This invention is directed to a horizontal casting apparatus having an improved mold mounting means which facilitates alignment of the mold with an ingot or billet support surface adjacent the discharge end of the mold.

12 Claims, 7 Drawing Figures

MOLD ALIGNMENT DEVICE FOR HORIZONTAL CASTING

BACKGROUND OF THE INVENTION

This invention generally relates to the horizontal casting of metals and is specifically directed to the alignment and mounting of the mold in a horizontal casting apparatus.

In the horizontal continuous D.C. casting of ingot and billet, generally molten metal is supplied to an elongated reservoir, commonly termed a feed box, which directs molten metals to one or more open ended molds wherein the molten metal is substantially solidified. Solidification within the mold is effected both by heat transfer through the mold walls and by the application of coolant (usually water) onto the surface of the ingot or billet as it emerges from the discharge end of the mold. Suitable means, such as a run-out table, rollers, belts or the like, must be provided a short distance away from the discharge end of the mold to support the ingot as it emerges from the mold because the partially solidified metal within the mold cannot support that part of the ingot or billet outside the mold.

The bottom surface of the emerging ingot or billet should be aligned level with the supporting surface to avoid any torsional loads on the forming ingot embryo within the mold. Torsional loads on the solidifying embryo can accentuate cold folds and other surface defects, can cause repetitive deformation of the ingot or billet and sometimes, if the load is great enough, can tear the embryo, resulting in molten metal flowing out of the mold. To assure that the bottom surface of the ingot or billet will lie on and be parallel to the pass line of the support surface, the mold is aligned with appropriate considerations given for metal shrinkage during solidification, such shrinkage being primarily size dependent.

Many methods and apparatus have been employed in the past to align the mold so as to maintain the lowest portion of the emerging ingot or billet level in the same plane as the pass line of the supporting surface. Most were either complicated or ineffective or both. Moreover, due to the methods employed to mount the mold onto the casting machine, any mold changes usually required realignment of the new mold which could be accomplished only by shutting down the entire casting operation.

It is against this background that the present invention was developed.

DESCRIPTION OF THE INVENTION

Figure 1:
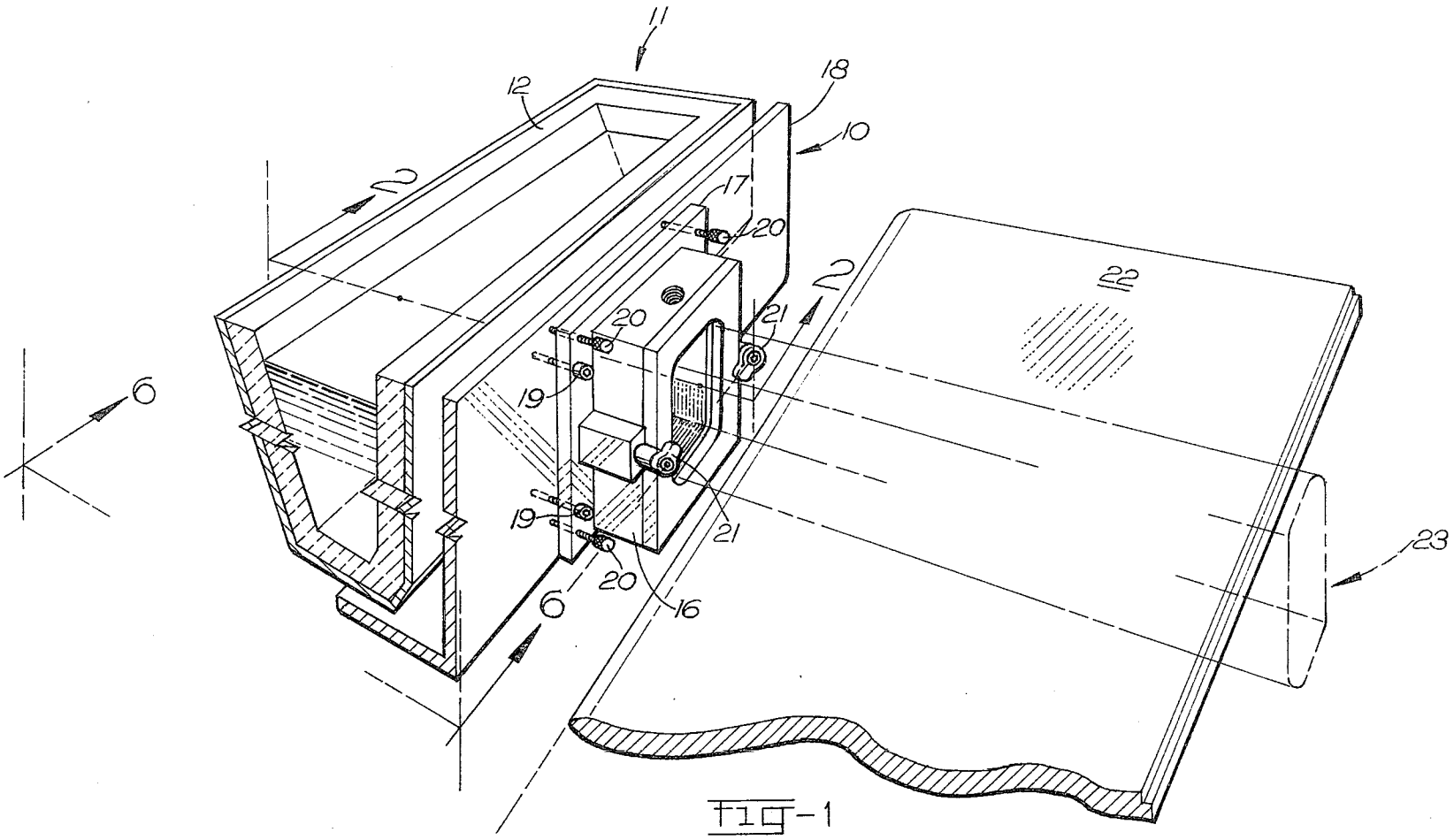
FIG. 1 is a perspective view of the horizontal casting apparatus of the invention.

This invention is directed to the continuous or semi-continuous horizontal casting of metal, particularly light metal such as aluminum, and is specifically directed to a method and apparatus for aligning and mounting a mold onto a horizontal casting apparatus so that the lowest surface of the ingot or billet lies on and is parallel to the pass line of the ingot or billet support surface.

In accordance with the invention, the casting molds are supported and aligned by means of a mounting plate attached to the front face of the casting unit. The mounting plate is provided with adjustable positioning means which contact the front face of the unit and thereby maintain the mounting plate in the desired orientation while the mounting plate is suitably attached to the front face of the casting unit. Means are also provided to attach the casting mold to the mounting plate and thereby align the mold in the desired manner.

To install the mounting plate in proper alignment, it is positioned onto the operative end of an alignment tool which is firmly positioned on top of the ingot or billet support surface of the casting machine. The alignment tool and mounting plate are then urged toward the front face of the casting unit with the alignment tool maintained firmly positioned onto the ingot or billet support surface so as to maintain a parallel relationship therebetween. The positioning elements on the mounting plate are adjusted to contact the front face of the casting unit and thereby maintain the desired orientation of the mounting plate while the mounting plate is firmly attached to the front face of the casting machine. The alignment bar can then be disengaged from the mounting plate and withdrawn. During the initial set up of the mounting plate, the casting mold may be attached to the mounting plate before or after the mounting plate is attached to the front face of the casting unit as will be more fully discussed below.

Reference is made to FIGS. 1 through 4 which illustrate a preferred embodiment of the invention. The horizontal casting apparatus 10 comprises a feed box 11 having a suitable refractory lining 12 and one or more feed openings 13. A refractory conduit 14 is sealed in the opening 13 and is adapted to direct molten metal from the feed box 11 to the feed end of the mold assembly 16. The mounting plate 17 is attached to the front face 18 of casting apparatus 10 by suitable means, such as screw members 19, shown in the drawings. At least 3 adjustable positioning screws 20 are provided to contact the front face 18 and maintain the mounting plate in a desired vertical position. Swing clamp assemblies 21 are adapted to urge the mold assembly 16 against the mounting plate 17 and into a sealed relationship with the refractory conduit 14. An ingot or billet support surface 22 is provided in front of the discharge end of mold assembly 16 a short distance away therefrom.

Figure 5:
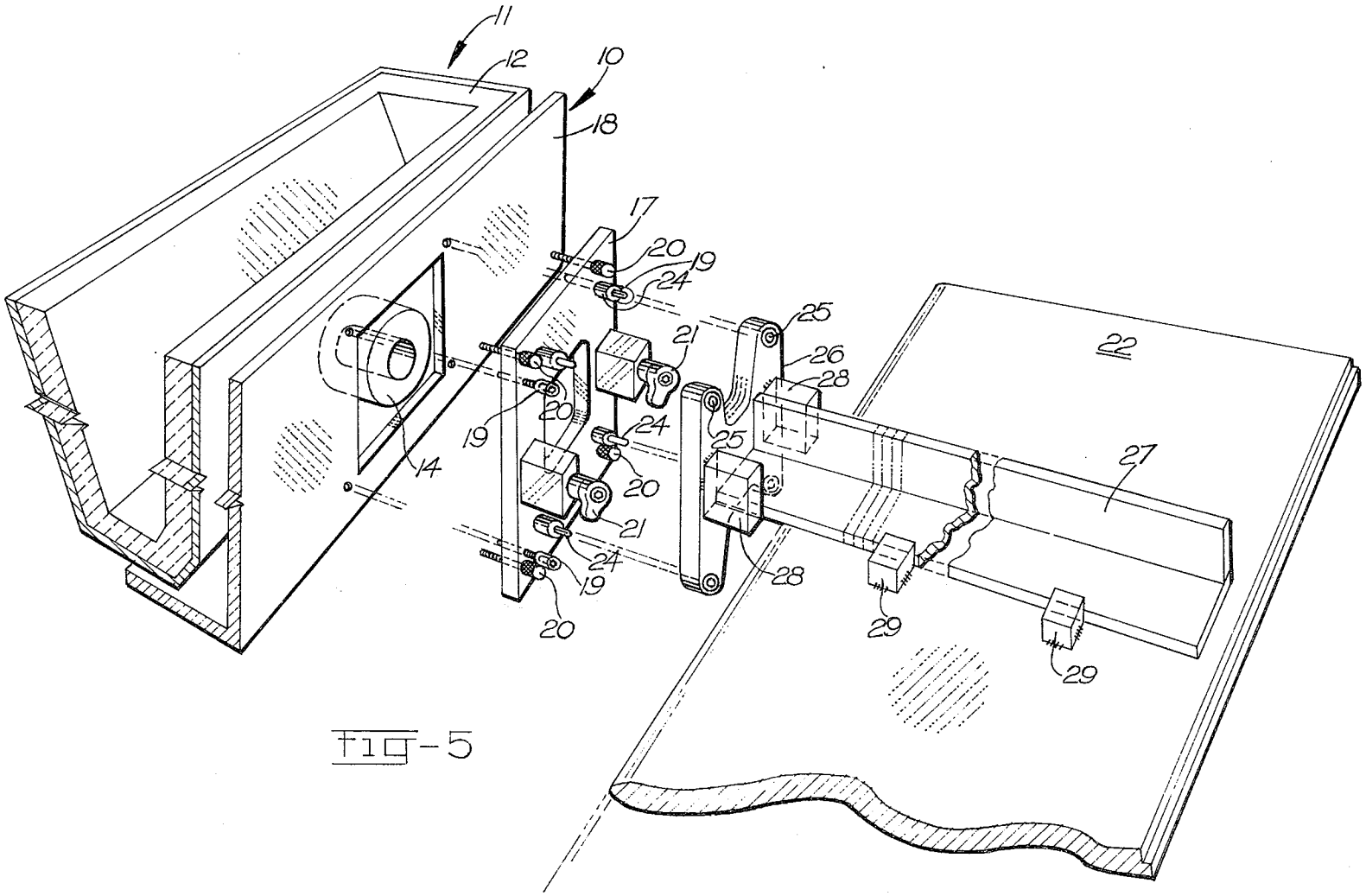
FIG. 5 is a perspective view partially in section.
Figure 6:
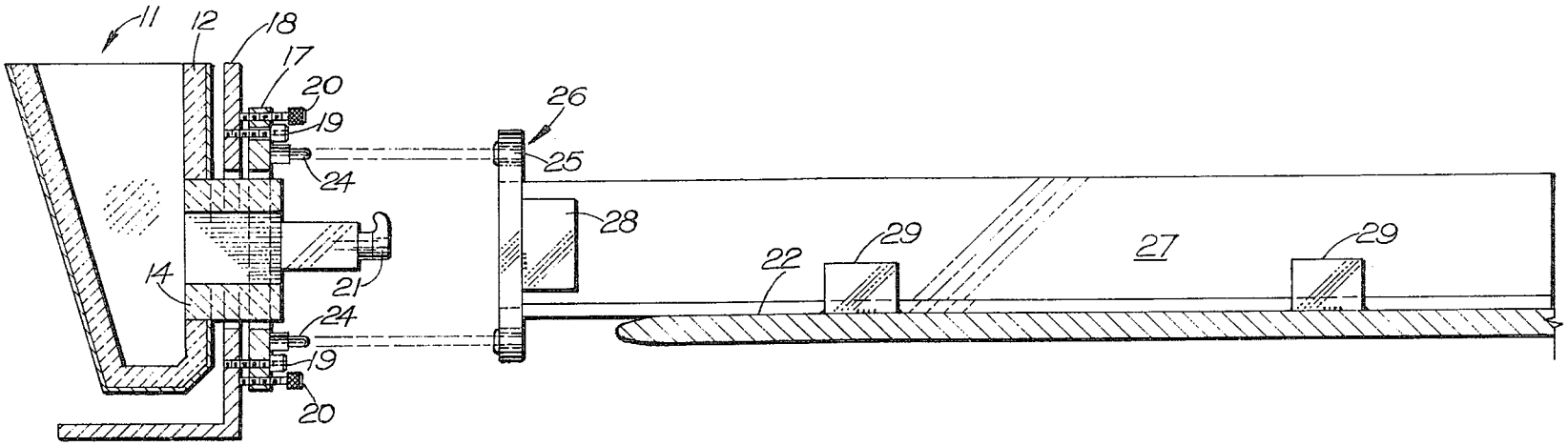
FIG. 6 is a cross-sectional view of the invention showing the method of installing the mounting plate of the invention.

The lowest portion of the emerging ingot 23 (shown in phantom in FIGS. 1 and 2) as previously mentioned must be on and level with the passline of the supporting surface 22 which requires the mold axis to be parallel with the pass line. To align the mold assembly 16 as illustrated in FIGS. 5 and 6, the mold mounting plate 17 is attached to the operative end 26 of alignment tool 27 by means of the guide pins 24 which tightly interfit the apertures 25 provided in the operative end 26 of the alignment tool 27. Swing clamp assemblies 21 are rotated so the arms of the assemblies swing over blocks 28 and the assemblies are then tightened thereto to firmly attach the mounting plate 17 to the alignment tool end 26. The elongated portion of alignment tool 26 is firmly placed on the support surface 22 against guide blocks 29, then urged toward the feed box 11 to engage mounting plate 17 with the front face 18. While the adjustment tool is firmly contacting the support surface 22 so as to maintain the mounting plate in the desired position, positioning screws 20 are adjusted so that all four screws are in firm contact with the front face 18. Locking screws 19 are then tightened to affix the properly positioned mounting plate 18 onto the front face 16 without changing the position of the mounting plate 17. The openings in the mounting plate for the locking screws 19 generally are sufficiently larger than the shaft of the screws to avoid the requirement of accurately placing threaded openings in the front face 17. Vertical slots (not shown) can be used for the openings for locking scews 19 in the mounting plate to allow for the installation of different sized molds onto the mounting plate.

When the mounting plate is appropriately installed, the guide pins 24 on mounting plate 17 are accurately positioned so that a mold assembly 16 can be installed onto the mounting plate with the guide pins 23 tightly interfitting the cavities 30 provided on the feed end of the mold assembly 16 to insure that the lowest surface of an ingot or billet emerging therefrom will be on the same plane as the pass line. Swing clamp assemblies 21 then are turned so that the arms thereof engage the discharge end of the mold assembly 16 and then tightened to urge the mold assembly 16 into contact with the mounting plate 17 and with the refractory conduit 14 so as to effect a seal thereto and prevent leakage of molten metal.

Figure 2:
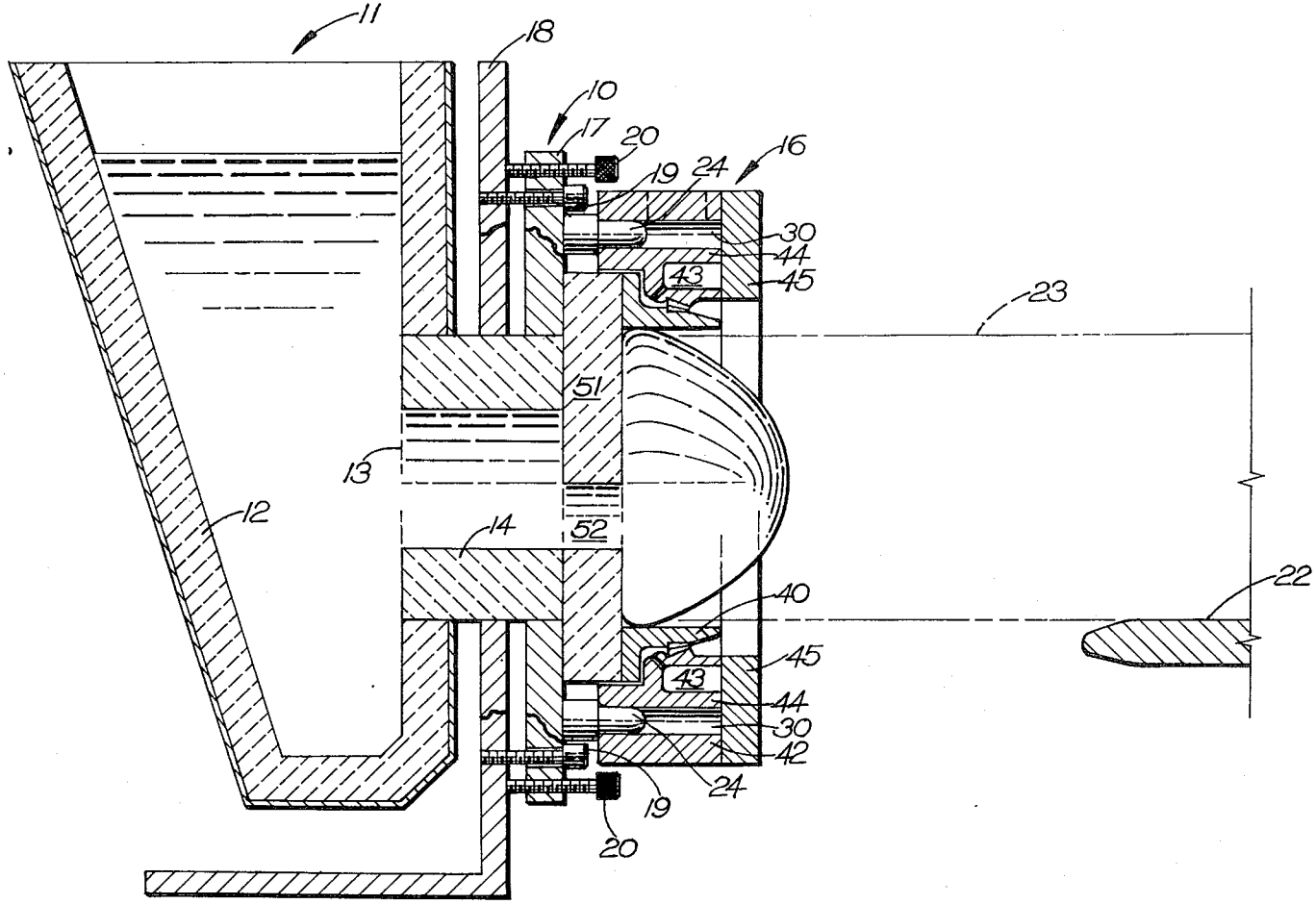
FIG. 2 is a cross-sectional view taken along the line 2—2 shown in FIG. 1.
Figure 3:
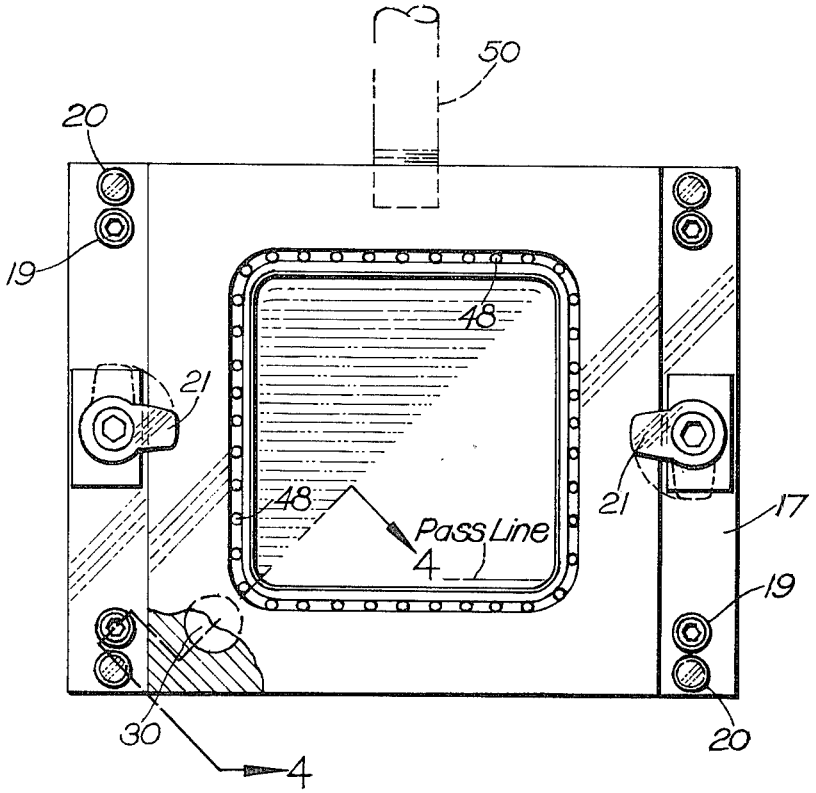
FIG. 3 is a front view of the mold assembly and mounting plate of the invention
Figure 4:
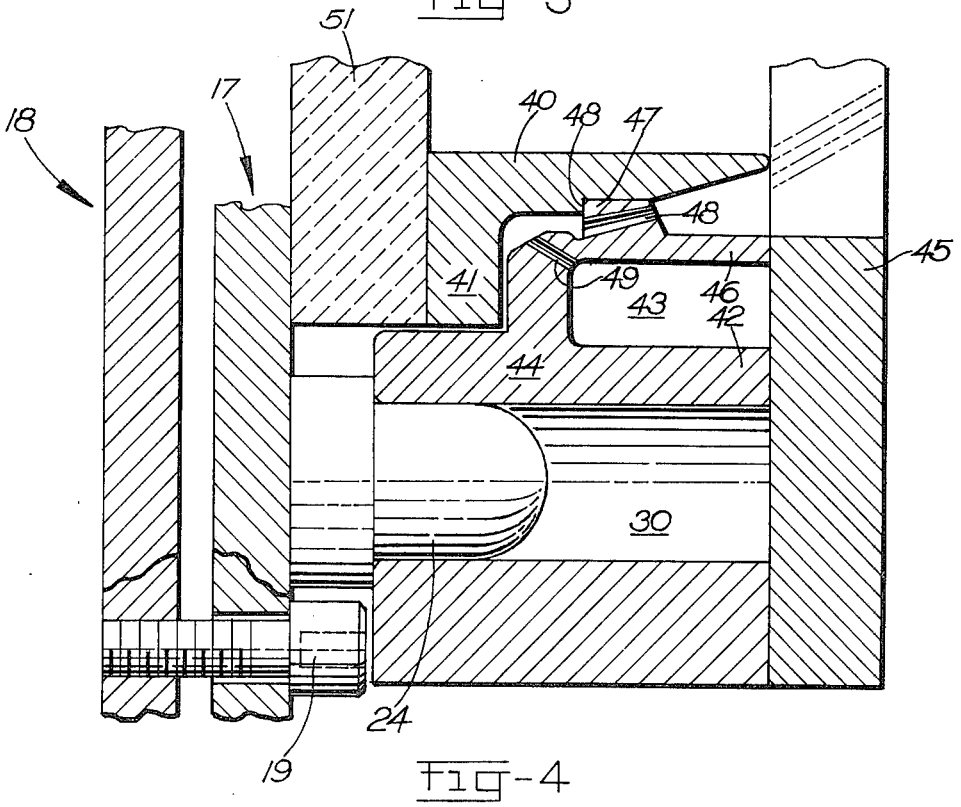
FIG. 4 is a sectional view taken along line 4—4 shown in FIG. 3.

The mold assembly 16 shown in FIGS. 2, 3 and 4 generally follows the teachings set forth in co-pending U.S. application Ser. No. 365,835, now U.S. Pat. No. 3,885,617, assigned to the present assignee. The mold assembly 16 comprises an open ended tubular mold body 40 having a flange 41 at the feed end thereof. A water jacket 42 surrounding the mold body 40 contains a water chamber 43 which is defined in part by leg 45 of water jacket 42. Leg 44 of the water jacket 40 is adapted to interfit the mold flange 41. The water jacket 42 is provided with a baffle 46 which includes a positioning element 47 having a plurality of coolant carrying passageways 48 for directing coolant onto the emerging ingot. The positioning element 47 on the baffle interfits with the recess 48 provided in the outer surfaces of the mold body 40 to provide a positive fit of the mold body 40 with respect to the baffle member and thereby control the positioning of the mold body 40. Conduits 49 are provided at the upper end of the baffle member 46 to direct coolant from chamber 43 to the outer surface of mold body 40. Coolant is supplied to chamber 43 through conduit 50. A refractory orifice plate 51 fits on the outer surface of the mold flange 41 and is provided with suitable openings 52 (see FIG. 2) to pass molten metal to the mold bore. When the mold assembly 16 is in position and the swing clamp assemblies 21 are tightened, the orifice plate 51 is in firm contact with the exposed face of the refractory conduit 14. Suitable gasket material is placed between the faying surfaces of the orifice plate 51 and the refractory conduit 14 to prevent molten metal seepage.

Once the mounting plate 17 is accurately positioned and firmly attached to the front face 18 of the casting apparatus 10, the mold assembly 16 can be removed and then remounted or a different mold mounted onto the mounting plate without the need for realignment. The front face of the casting apparatus is preferably separated from the feed box 11 to avoid thermal distortion which can cause misalignment of the mounting plate 17 and the mold assembly 16.

With the present invention, molds can be readily changed while the casting unit is in operation yet still be properly aligned. To effect such changes, the opening from the feed box to the mold is blocked off in a suitable manner, and the water and lubricant lines are disengaged from the mold assembly 16. The mold assembly can then be removed by turning the swing clamp assemblies 21 so as to disengage the mold assembly 16 from the refractory conduit 14. The new mold assembly is placed onto the mold mounting plate and urged into sealing engagement with the refractory conduit 14. The coolant and lubricant lines reconnected and the unit is ready for casting. A bait bar assembly is inserted into the mold bore, the conduit 14 blockage is removed, the ingot is then urged out of the mold and the casting proceeds.

Figure 7:
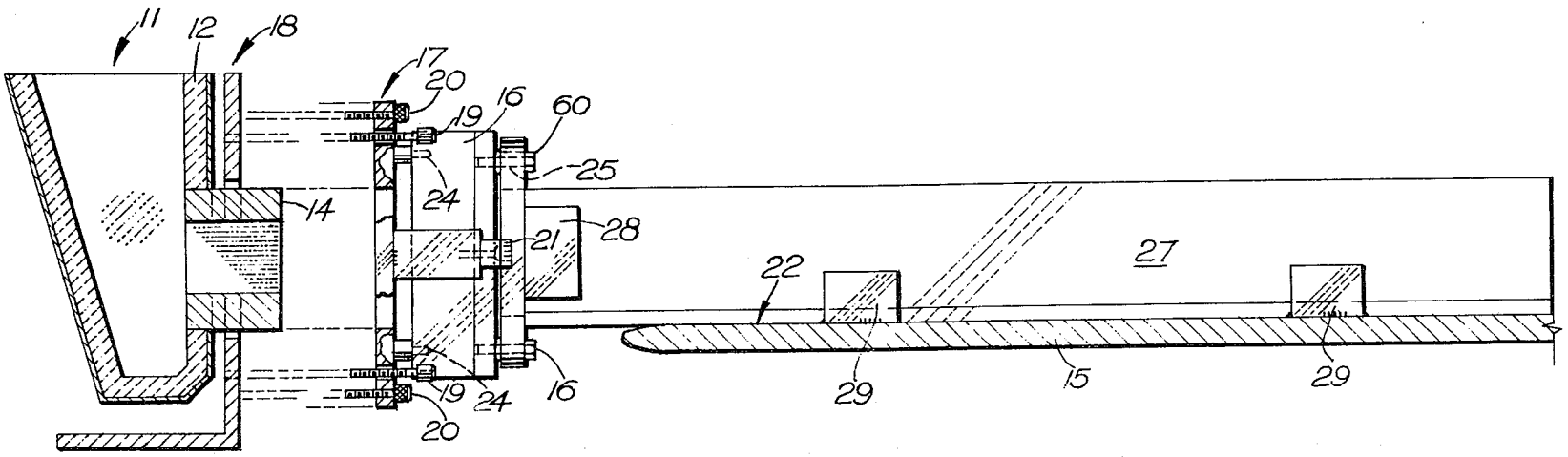
FIG. 7 is a side view partially in section of a modification of the apparatus of the invention.

Reference is now made to FIG. 7 which illustrates another embodiment of the invention, wherein the mold assembly 16 is first attached to the mounting plate 17 by the guide means 24 which tightly interfit the receiving cavity 30 of mold assembly 16 by swing arm assemblies 21. The combined mounting plate-mold assembly is then fixed onto the operative end 26 of alignment tool 27 by means of screws 60. The alignment tool 27 then is placed on the support surface 22, urged toward the feed box 11 so as to place the mounting plate-mold assembly into the desired position as previously described. The adjusting screws 20 are appropriately adjusted so that all four of the positioning screws are in firm contact with the front face 18 of the casting unit 10. The locking screws 19 are tightened so as to firmly attach the mounting plate-mold assembly onto the front face 18. The alignment tool 27 is then disengaged and withdrawn.

With the apparatus of the present invention, molds can be quickly aligned and mounted and thereby significantly reduce the downtime required for a station change on the casting unit. Moreover, with one of the preferred embodiments, the molds need not be attached at the same time the mounting plate is attached which frequently is a significant operational advantage. There is generally no need for precision measuring tools usually required with the prior art methods of alignment. Because no instruments come in contact with the mold bore in the present invention, no damage can be done to the mold bore. The present system of mounting molds readily allows molds of different diameters to be employed in the same casting unit. Most importantly, the system allows for the changing of a mold during the operation of a multistrand casting unit, even to different sized molds, without the necessity for shutting down the entire casting apparatus.

It is obvious that various modifications and improvements can be made to the invention without departng from the spirit thereof and the scope of the appended claims.

What is claimed is:

1. In a continuous or semicontinuous horizontal casting apparatus comprising a molten metal reservoir, a vertically oriented front surface, at least one open ended mold assembly supported by the front surface, conduit means to direct molten metal from the reservoir to the feed end of the mold, and an ingot or billet support surface adjacent the discharge end of the mold, the improvement comprising a. a mounting plate attached to the vertically oriented front surface having adjustable positioning means contacting the front face which maintain the mounting plate in a desired orientation, and b. means to attach the mold assembly to the mounting plate so that the lowest portion of the emerging ingot or billet lies on and is parallel to the pass line of the ingot or billet support surface.

2. The horizontal casting apparatus of claim 1 wherein the adjustable positioning means comprises at least 3 threaded screw members.

3. The horizontal casting apparatus of claim 1 wherein the means to attach the mold assembly to the mounting plate include a plurality of guide pins and matching receiving cavities associated with the mounting plate and mold.

4. The horizontal casting apparatus of claim 1 wherein the mold assembly is a water-jacketed D.C. casting mold.

5. The horizontal casting apparatus of claim 3 wherein the means to attach the mold to the mounting plate include a plurality of assemblies disposed adjacent the mold assembly and fixed to the mounting plate, having arms extending over the edges of the mold which urge the mold toward the mounting plate and the conduit means.

6. In a continuous or semicontinuous horizontal casting apparatus comprising a molten metal reservoir, a vertically oriented front face, at least one open ended mold assembly supported by the front surface, conduit means to direct molten metal from the reservoir to the feed end of the mold assembly and an ingot or billet support surface positioned in front of the discharge end of the mold assembly, the improvement in the means for aligning of the mold with respect to the pass line of the support surface comprising a. a mounting plate provided with adjustable positioning means which are adapted to contact the front face and maintain the mounting plate in a desired orientation and provided with means to attach the mounting plate to the front surface, b. an elongated alignment tool having associated with the operative end thereof means to receive and support the mounting plate and to maintain said mounting plate in a desired position with respect to the alignment tool, the alignment tool adapted to be positioned on the support surface and thereby align the mounting plate with respect to the passs line of the support surface, and c. means associated with the mounting plate to position and affix an open ended mold assembly thereto to align the mold so that the lowest portion of the ingot or billet emerging from the mold lies on and is parallel to the pass line of the support surface.

7. The horizontal casting apparatus of claim 6 wherein the adjustable positioning means comprises at least 3 threaded screw members.

8. The horizontal casting apparatus of claim 3 wherein the means to attach the mold to the mounting plate includes a plurality of guide pins and matching receiving cavities associated with the mounting plate and mold.

9. The horizontal casting apparatus of claim 6 wherein the mold is a water-jacketed D.C. casting mold.

10. The horizontal casting apparatus of claim 8 wherein the means to attach the mold to the mounting plate include a plurality of assemblies disposed adjacent the mold and fixed to the mounting plate, having arms extending over the edges of the mold assembly which urge the mold toward the mounting plate and the conduit means.

11. In a horizontal continuous or semicontinuous casting apparatus comprising a molten metal reservoir, a vertically oriented front surface, at least one open ended mold assembly supported by the front surface, a conduit adapted to direct molten metal from the reservoir to the feed end of the mold assembly and an ingot or billet support surface adjacent the discharge end of the mold assembly, the method of aligning the mold assembly with respect to the ingot or billet support surface so that the lowest surface of an ingot or billet emerging from the mold assembly lies on and is parallel to the pass line of the ingot or billet support surface comprising a. disposing a mounting plate adjacent the front surface by means of an elongated alignment tool which is supported by and parallel to the ingot or billet support surface, b. adjusting a plurality of positioning elements provided with said mounting plate to contact therewith the front surface to thereby position the mounting plate in a desired orientation, c. attaching the mounting plate to the front face without changing the position of the mounting plate, d. withdrawing the alignment tool, and e. attaching an open ended mold assembly to the mounting plate.

12. In a horizontal continuous or semicontinuous casting apparatus comprising a molten metal reservoir, a vertically oriented front surface, at least one open ended mold assembly supported by the front surface, a conduit adapted to direct molten metal from the reservoir to the feed end of the mold assembly and an ingot or billet support surface adjacent the discharge end of the mold assembly, the method of aligning the mold assembly with respect to the ingot or billet support surface so that the lowest surface of an ingot or billet emerging from the mold assembly lies on and is parallel to the pass line of the ingot or billet support surface comprising a. attaching an open ended mold assembly to a mounting plate, b. disposing the mounting plate and attached mold assembly adjacent the front surface by means of an elongated alignment tool which is supported by and parallel to the ingot or billet support surface, c. adjusting a plurality of positioning elements provided with said mounting plate to contact therewith the front surface to thereby position the mounting plate and attached mold in a desired orientation, d. attaching the mounting plate to the front face withoutt changing the position of the mounting plate and the attached mold assembly, and e. disengaging the alignment tool from the mounting plate and attached mold assembly.

* * * * *